US010513938B2

(12) United States Patent
Witlicki et al.

(10) Patent No.: US 10,513,938 B2
(45) **Date of Patent: *Dec. 24, 2019**

(54) INTERSHAFT COMPARTMENT BUFFERING ARRANGEMENT

(71) Applicant: United Technologies Corporation, Farmington, CT (US)

(72) Inventors: Russell B. Witlicki, Wethersfield, CT (US); Todd A. Davis, Tolland, CT (US); Francis Parnin, Suffield, CT (US)

(73) Assignee: United Technologies Corporation, Farmington, CT (US)

( * ) Notice: Subject to any disclaimer, the term of this patent is extended or adjusted under 35 U.S.C. 154(b) by 241 days.

This patent is subject to a terminal disclaimer.

(21) Appl. No.: 15/496,399

(22) Filed: Apr. 25, 2017

(65) Prior Publication Data

US 2018/0306044 A1 Oct. 25, 2018

(51) Int. Cl.

| | |
|---|---|
| ***F01D 5/18*** | (2006.01) |
| ***F01D 11/00*** | (2006.01) |
| ***F01D 25/16*** | (2006.01) |
| ***F04D 27/00*** | (2006.01) |
| ***F04D 29/054*** | (2006.01) |

(Continued)

(52) U.S. Cl.

CPC ..... *F01D 11/003* (2013.01); *F01D 5/026* (2013.01); *F01D 25/162* (2013.01); *F01D 25/183* (2013.01); *F04D 27/009* (2013.01); *F04D 29/054* (2013.01); *F05D 2220/32* (2013.01); *F05D 2240/60* (2013.01)

(58) Field of Classification Search

None

See application file for complete search history.

(56) References Cited

U.S. PATENT DOCUMENTS 4,031,407 A * 6/1977 Reed ..... H02J 3/42 290/1 R
4,380,146 A * 4/1983 Yannone ..... F02C 9/26 60/39.281

(Continued)

FOREIGN PATENT DOCUMENTS

GB 1095129 12/1967
WO WO2013141926 9/2013

OTHER PUBLICATIONS

EP search report for EP18158465.7 dated Aug. 10, 2018.

*Primary Examiner* — Michael Lebentritt
(74) *Attorney, Agent, or Firm* — O'Shea Getz P.C.

(57) ABSTRACT

Aspects of the disclosure are directed to a system associated with an engine having a central longitudinal axis, including a first shaft axially extending along the central longitudinal axis, a second shaft coaxial with the first shaft, a first air seal that seals between the first shaft and the second shaft at a first axial location, a second air seal that seals between the first shaft and the second shaft at a second axial location, a first oil seal that provides intershaft sealing between the first shaft and the second shaft at a third axial location, a second oil seal that provides intershaft sealing between the first shaft and the second shaft at a fourth axial location axially adjacent to the third axial location, and a high pressure compressor that provides pressurized air to a first radially exterior side of the first air seal and to a second radially exterior side the second air seal.

7 Claims, 4 Drawing Sheets

(51) Int. Cl.
*F01D 5/02* (2006.01)
*F01D 25/18* (2006.01)

(56) References Cited

U.S. PATENT DOCUMENTS

| | | | | |
|---|---|---|---|---|
| 4,536,126 | A * | 8/1985 | Reuther | H02J 3/42 290/40 R |
| 5,564,896 | A | 10/1996 | Beeck et al. | |
| 6,131,914 | A * | 10/2000 | Proveaux | F01D 25/183 277/412 |
| 6,470,666 | B1 * | 10/2002 | Przytulski | F01D 25/125 184/6.11 |
| 7,624,580 | B2 | 12/2009 | Fukutani | |
| 8,092,093 | B2 * | 1/2012 | Fang | F01D 25/183 277/423 |
| 8,714,905 | B2 | 5/2014 | Fintescu et al. | |
| 9,598,972 | B2 * | 3/2017 | Strock | F01D 11/122 |
| 9,650,906 | B2 * | 5/2017 | Gore | F01D 11/02 |
| 9,879,607 | B2 * | 1/2018 | Brunet | F01D 11/02 |
| 10,036,508 | B2 * | 7/2018 | Bordne | F01D 11/04 |
| 10,145,258 | B2 * | 12/2018 | Strock | C23C 4/10 |
| 10,161,314 | B2 * | 12/2018 | Parnin | F02C 7/28 |
| 2013/0078091 | A1 | 3/2013 | Rees | |
| 2015/0240660 | A1 | 8/2015 | Sonokawa et al. | |
| 2016/0169040 | A1 | 6/2016 | Anglin et al. | |

* cited by examiner

INTERSHAFT COMPARTMENT BUFFERING ARRANGEMENT

STATEMENT REGARDING FEDERALLY SPONSORED RESEARCH OR DEVELOPMENT

This invention was made with government support under contract number FA8626-16-C-2139 awarded by the United States Air Force. The government has certain rights in the invention.

BACKGROUND

Gas turbine engines, such as those which power aircraft and industrial equipment, employ a compressor to compress air that is drawn into the engine and a turbine to capture energy associated with the combustion of a fuel-air mixture. Referring to FIG. 2, a prior art system 200 associated with an engine is shown. The system 200 is referenced with respect to a centerline/axis 202. For example, the components of the system 200 that are described below are arranged relative to the axis 202 as shown in FIG. 2.

The system 200 is shown as part of a two-spool configuration that includes a first, low speed shaft 214 and a second, high speed shaft 220. The shafts 214 and 220 are rotatably supported by a plurality of bearings contained within a bearing compartment 224.

In FIG. 2, various locations of the engine are denoted by letters A-D. At each of these locations A-D, a pair of seals are shown. Seals are used in the system 200 to isolate a fluid from one or more areas/regions of the engine. Seals control various parameters (e.g., temperature, pressure) within the areas/regions of the engine and ensure proper/efficient engine operation and stability. At location A, an air seal 230*a* and an oil seal 234*a* are shown. At location B, an air seal 230*b* and an oil seal 234*b* are shown. Each of the oil seal comprises a radially interior side/surface and radially exterior side/surface. At location C, an air seal 230*c* and an oil seal 234*c* are shown. At location D, an air seal 230*d* and an oil seal 234*d* are shown.

The seals 230*a* and 234*a* are used to seal the bearing compartment 224 with respect to the shaft 214. The seals 230*d* and 234*d* are used to seal the bearing compartment 224 with respect to the shaft 220. The seals 230*b*, 234*b*, 230*c*, and 234*c* are used to provide intershaft sealing between the shafts 214 and 220, in an area/region where the shafts 214 and 220 interact with or surround one another.

A buffer source 228-1 provides air that interfaces to/between each of the pairs of seals (e.g., air seal and oil seal) at the respective locations A-D. Conventionally, the buffer source 228-1 originates from one or more stages of a low pressure compressor (LPC), such as for example an axially aft-most stage of the LPC. In some instances, the air from the buffer source 228-1 may be at a greater pressure than the air pressure associated with a high pressure compressor (HPC) 228-2 of the compressor, such that air may flow from the buffer source 228-1, across the air seals 230*b* and 230*c*, and into the sink represented by the HPC 228-2. Typical, commercially available off the shelf (COTS) seals that may otherwise be used for the air seals 230*b* and 230*c* may not be configured to operate in such a manner, such that the air flowing across the air seals 230*b* and 230*c* as described above may degrade the service lifetime of such air seals 230*b* and 230*c* and/or render the air seals 230*b* and 230*c* inoperative, such that there may be an increased risk/potential of oil leaking out of the bearing compartment 224.

BRIEF SUMMARY

The following presents a simplified summary in order to provide a basic understanding of some aspects of the disclosure. The summary is not an extensive overview of the disclosure. It is neither intended to identify key or critical elements of the disclosure nor to delineate the scope of the disclosure. The following summary merely presents some concepts of the disclosure in a simplified form as a prelude to the description below.

Aspects of the disclosure are directed to a system associated with an engine having a central longitudinal axis. The system may comprise a first shaft axially extending along the central longitudinal axis. The system may further comprise a second shaft coaxial with the first shaft. The system may also comprise a first air seal that seals between the first shaft and the second shaft at a first axial location. The system may comprise a second air seal that seals between the first shaft and the second shaft at a second axial location. The system may further comprise a first oil seal that provides intershaft sealing between the first shaft and the second shaft at a third axial location. The system may comprise a second oil seal that provides intershaft sealing between the first shaft and the second shaft at a fourth axial location axially adjacent to the third axial location. The system may further comprise a high pressure compressor that provides pressurized air to a first radially exterior side of the first air seal and to a second radially exterior side the second air seal.

The first air seal and the second air seal may consume a portion of the air.

The system may comprise a first oil seal that is substantially located at the first axial location. The system may further comprise a second oil seal that is substantially located at the second axial location.

According to another aspect of the present disclosure, a gas turbine engine is provided. The gas turbine engine may comprise an inner shaft. The gas turbine engine may further comprise an outer shaft concentrically surrounding at least a portion of the inner shaft, wherein an interface between the outer shaft and the inner shaft is located within an annulus. The gas turbine engine may also comprise an oil seal positioned within the annulus and configured to prevent lubricating oil in the annulus from entering the interface. The gas turbine engine may comprise a high pressure compressor configured to provide pressurized air to a radially exterior side of the oil seal and configured to provide the pressurized air to a radially interior side of the oil seal.

The outer shaft may comprise a high pressure compressor shaft and the inner shaft may comprise a low pressure turbine shaft.

According to another aspect of the present disclosure, a gas turbine engine is provided. The gas turbine engine may comprise an intershaft seal separating a bearing compartment from an annulus and configured to prevent a lubricating oil in the bearing compartment from entering the annulus. The gas turbine engine may further comprise an outer shaft concentrically surrounding at least a portion of an inner shaft, where an interface between the outer shaft and the inner shaft is located within the annulus. The gas turbine engine may also comprise an oil seal positioned within the annulus and configured to prevent lubricating oil in the annulus from entering the interface. The gas turbine engine may comprise a high pressure compressor configured to provide pressurized air to a radially exterior side of the oil seal and configured to provide the pressurized air to a radially interior side of the oil seal.

According to another aspect of the present disclosure, a system for a gas turbine engine is provided. The system may comprise a first shaft axially extending along an engine central longitudinal axis. The system may also comprise a second shaft coaxial with and radially exterior to the first shaft. The system may further comprise a first air seal and oil seal pair at an axial upstream position that seals a bearing compartment with respect to one of the first shaft and the second shaft and a second air seal and oil seal pair at an axial downstream position that seals the bearing compartment with respect to another of the first shaft and the second shaft. The system may comprise a plurality of intershaft seals radially between the first shaft and the second shaft and axially between the first air seal and oil seal pair and the second first air seal and oil seal pair, wherein each of the intershaft seals is an oil seal and wherein buffer air diverted from an engine compressor is delivered to at least a first intershaft space axially between at least a first pair of adjacent intershaft seals from the plurality of intershaft seals.

BRIEF DESCRIPTION OF THE DRAWINGS

The present disclosure is illustrated by way of example and not limited in the accompanying figures in which like reference numerals indicate similar elements. The drawing figures are not necessarily drawn to scale unless specifically indicated otherwise.

DETAILED DESCRIPTION

Figure 1:
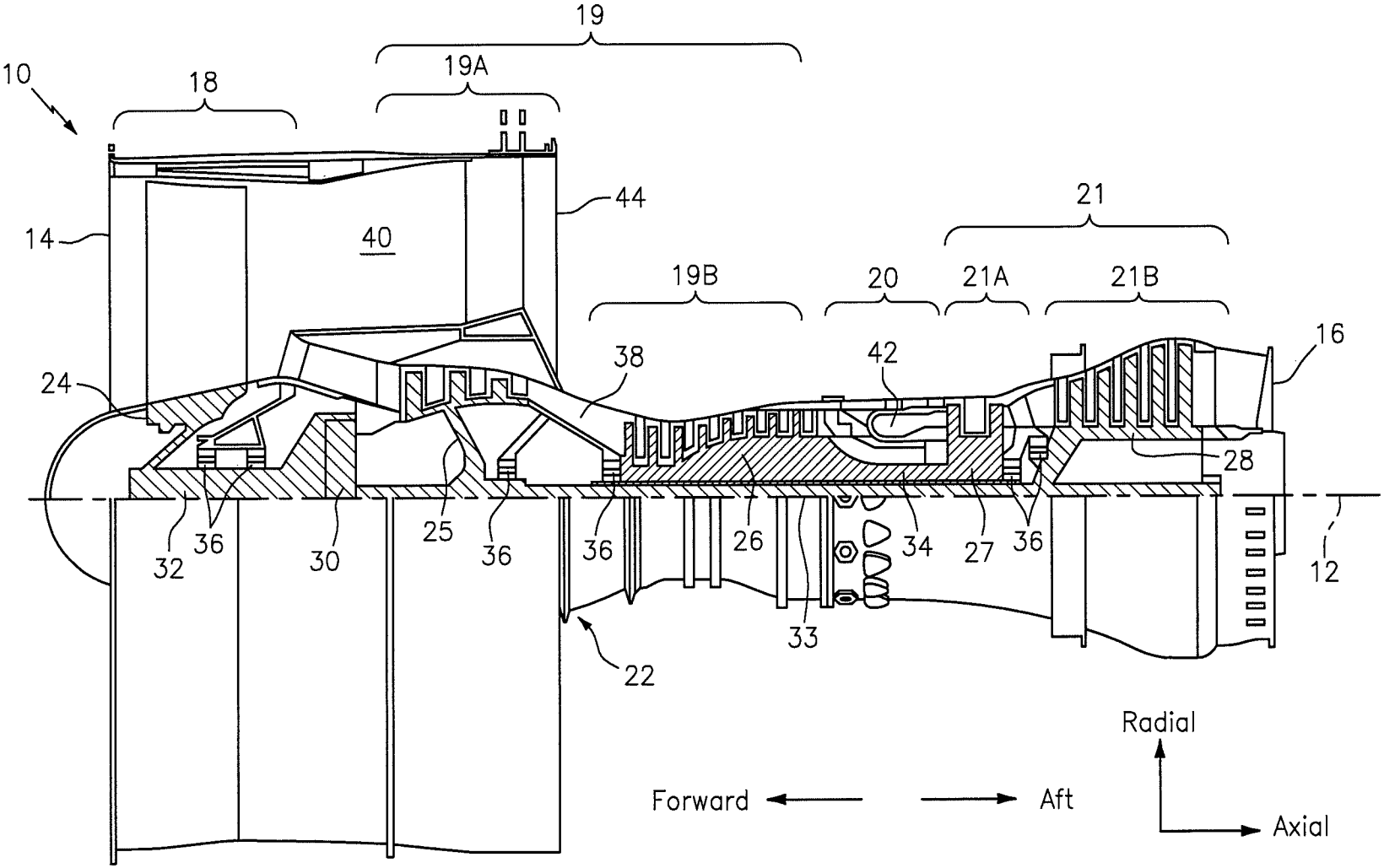
FIG. 1 is a side cutaway illustration of a geared turbine engine.

It is noted that various connections are set forth between elements in the following description and in the drawings (the contents of which are incorporated in this specification by way of reference). It is noted that these connections are general and, unless specified otherwise, may be direct or indirect and that this specification is not intended to be limiting in this respect. A coupling between two or more entities may refer to a direct connection or an indirect connection. An indirect connection may incorporate one or more intervening entities or a space/gap between the entities that are being coupled to one another.

Aspects of the disclosure may be applied in connection with a gas turbine engine. FIG. 1 is a side cutaway illustration of a geared turbine engine 10. This turbine engine 10 extends along an axial centerline 12 between an upstream airflow inlet 14 and a downstream airflow exhaust 16. The turbine engine 10 includes a fan section 18, a compressor section 19, a combustor section 20 and a turbine section 21. The compressor section 19 includes a low pressure compressor (LPC) section 19A and a high pressure compressor (HPC) section 19B. The turbine section 21 includes a high pressure turbine (HPT) section 21A and a low pressure turbine (LPT) section 21B.

The engine sections 18-21 are arranged sequentially along the centerline 12 within an engine housing 22. Each of the engine sections 18-19B, 21A and 21B includes a respective rotor 24-28. Each of these rotors 24-28 includes a plurality of rotor blades arranged circumferentially around and connected to one or more respective rotor disks. The rotor blades, for example, may be formed integral with or mechanically fastened, welded, brazed, adhered and/or otherwise attached to the respective rotor disk(s).

The fan rotor 24 is connected to a gear train 30, for example, through a fan shaft 32. The gear train 30 and the LPC rotor 25 are connected to and driven by the LPT rotor 28 through a low speed shaft 33. The HPC rotor 26 is connected to and driven by the HPT rotor 27 through a high speed shaft 34. The shafts 32-34 are rotatably supported by a plurality of bearings 36; e.g., rolling element and/or thrust bearings. Each of these bearings 36 is connected to the engine housing 22 by at least one stationary structure such as, for example, an annular support strut.

As one skilled in the art would appreciate, in some embodiments a fan drive gear system (FDGS), which may be incorporated as part of the gear train 30, may be used to separate the rotation of the fan rotor 24 from the rotation of the rotor 25 of the low pressure compressor section 19A and the rotor 28 of the low pressure turbine section 21B. For example, such an FDGS may allow the fan rotor 24 to rotate at a different (e.g., slower) speed relative to the rotors 25 and 28.

During operation, air enters the turbine engine 10 through the airflow inlet 14, and is directed through the fan section 18 and into a core gas path 38 and a bypass gas path 40. The air within the core gas path 38 may be referred to as "core air". The air within the bypass gas path 40 may be referred to as "bypass air". The core air is directed through the engine sections 19-21, and exits the turbine engine 10 through the airflow exhaust 16 to provide forward engine thrust. Within the combustor section 20, fuel is injected into a combustion chamber 42 and mixed with compressed core air. This fuel-core air mixture is ignited to power the turbine engine 10. The bypass air is directed through the bypass gas path 40 and out of the turbine engine 10 through a bypass nozzle 44 to provide additional forward engine thrust. This additional forward engine thrust may account for a majority (e.g., more than 70 percent) of total engine thrust. Alternatively, at least some of the bypass air may be directed out of the turbine engine 10 through a thrust reverser to provide reverse engine thrust.

FIG. 1 represents one possible configuration for an engine 10. Aspects of the disclosure may be applied in connection with other environments, including additional configurations for gas turbine engines. Aspects of the disclosure may be applied in connection with non-geared engines.

Figure 3:
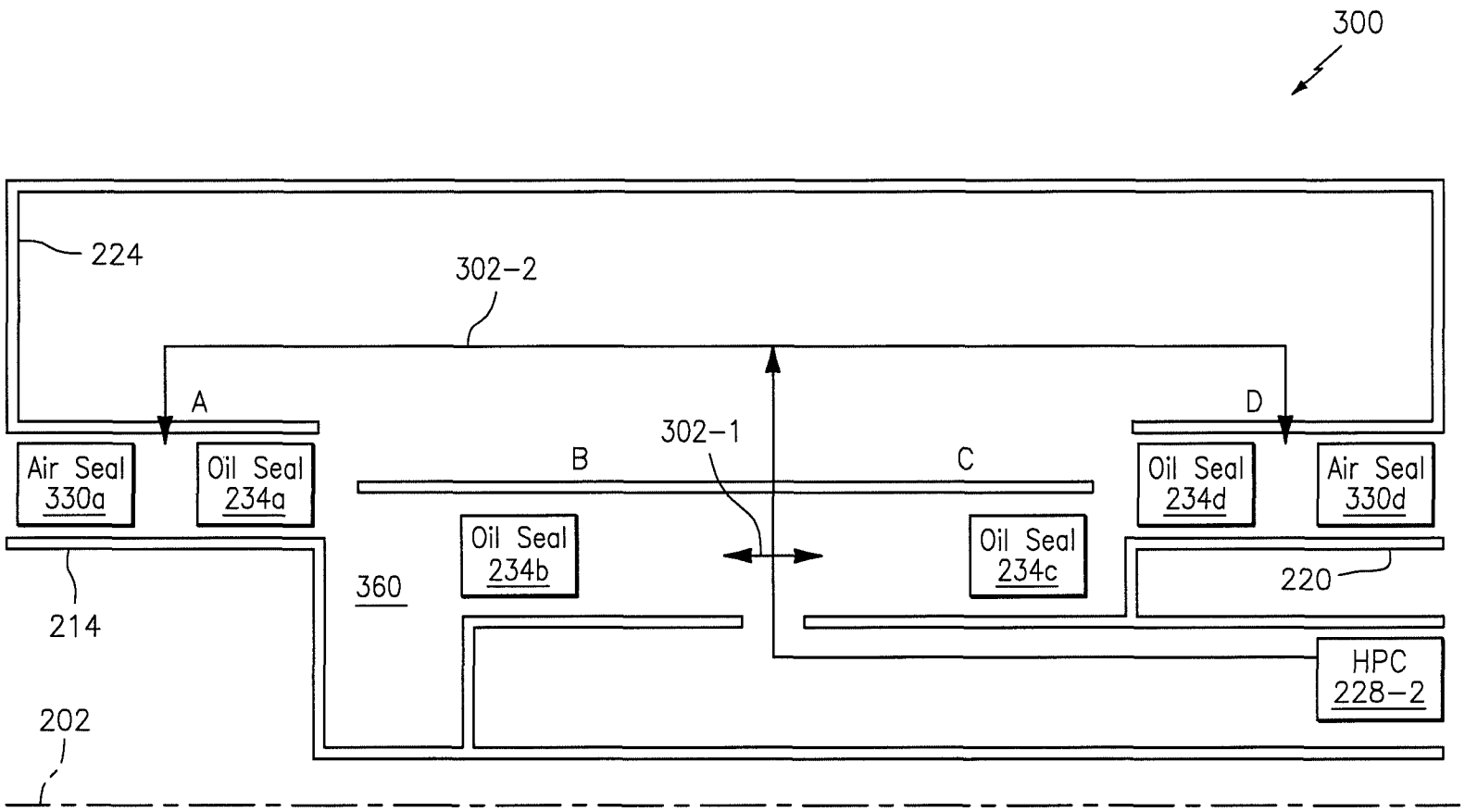
FIG. 3 illustrates a simplified illustration of a system of an engine that incorporates seals and a buffer air source in accordance with aspects of this disclosure.

Referring to FIG. 3, a simplified illustration of a vented buffer air supply system 300 for, e.g., intershaft seals is shown. Differences between the system 200 and the system 300 are described below.

The system 300 may include an air seal 330*a* at the A location and an air seal 330*d* at the D location. At the A location, the air seal 330*a* and the oil seal 234*a* may be used to seal the bearing compartment 224 with respect to the shaft 214. At the D location, the air seal 330*d* and the oil seal 234*d* may be used to seal the bearing compartment 224 with respect to the shaft 220. At the B and C locations, the oil seal 234*b* and the oil seal 234*c*, respectively, may be used to provide intershaft sealing between the shafts 214 and 220, in an area/region where the shafts 214 and 220 interact with or surround one another. Location A represents a location in front of #2 bearing. Location B represents a location behind #2 bearing on low speed shaft. Location C represents a location in front of #3 bearing on high speed shaft. Location D represents a location behind #3 bearing.

Figure 2:
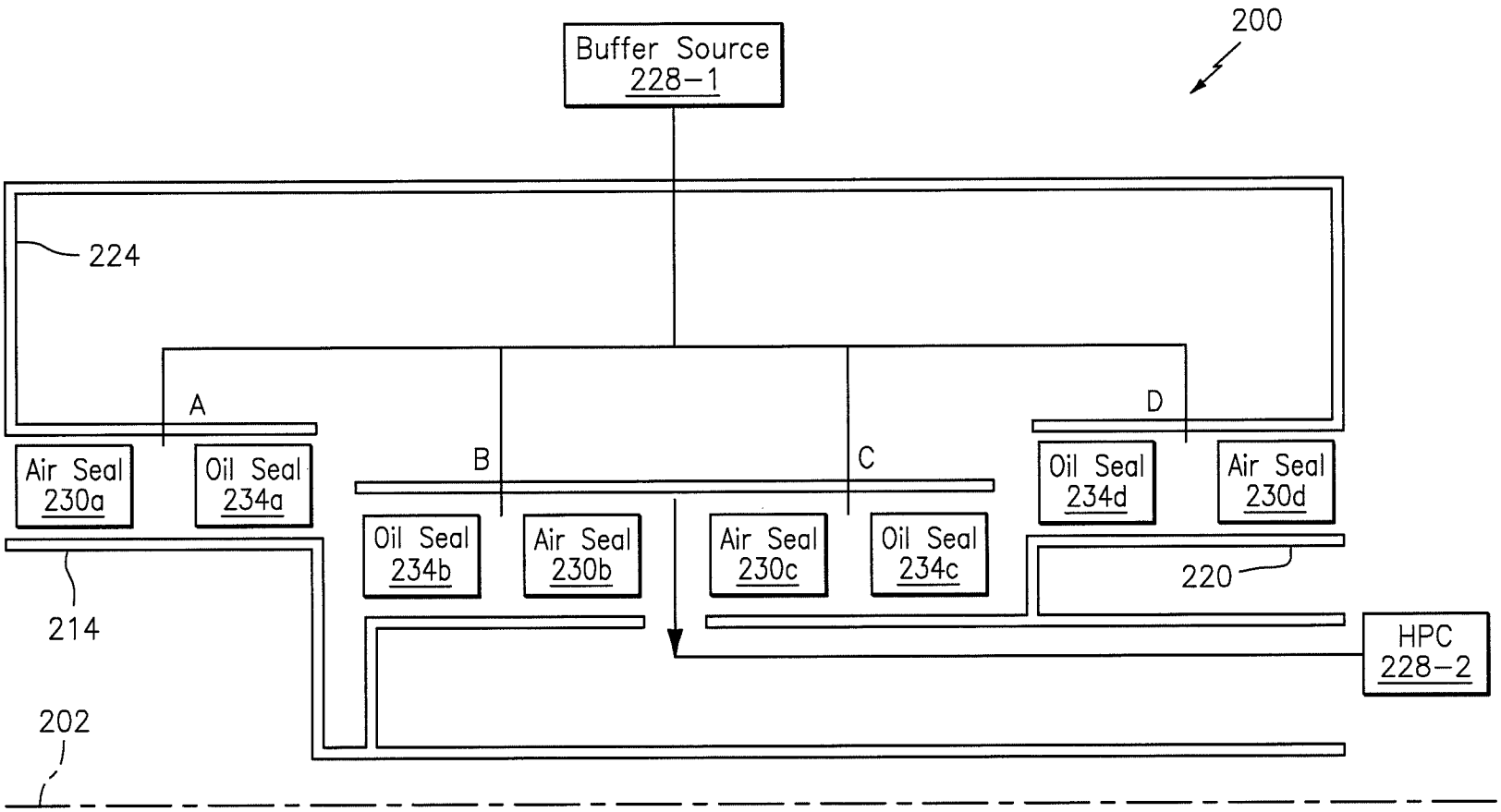
FIG. 2 (PRIOR ART)
FIG. 2 illustrates a simplified illustration of a system of an engine that incorporates seals and a buffer air source in accordance with the prior art.

As shown in FIG. 3, the HPC 228-2 (which may correspond to the high pressure compressor (HPC) section 19B of FIG. 1) may be used as a source of air for buffering the seals. Stated slightly differently, the system 300 may not utilize a buffer source (e.g., the buffer source 228-1 of FIG. 2) in relation to pressurizing the bearing compartment 224. In FIG. 3, a portion of the air from the HPC 228-2 (denoted by arrows 302-1) may be used/consumed with respect to the seals at the B and C locations. A portion of the air from the HPC 228-2 (denoted by arrows 302-2) may be used/consumed with respect to the seals at the A and D locations.

Using HPC air for the intershaft compartment seals ensure they operate with the correct pressurization and it prevents backflow of HPC air into low pressure areas. Having generally equal pressure on the radially interior and exterior surface of the seals in the intershaft compartment reduces oil loss from the compartment in the event of a seal failure. Using HPC air as the buffer source allows the prior art air seals 230*b*, 230*c* (FIG. 2) to be eliminated in the intershaft compartment buffering arrangement illustrated in FIG. 3. This of course reduces weight and expense. Referring still to FIG. 3, if an oil seal fails, pressure within the compartment will increase, but oil will be retained within the compartment 224 since the HPC air is feeding the source for all seals. The oil seals 234*b*, 234*c* are positioned in the annulus and configured to prevent lubricating oil in the annulus from entering the interface.

Figure 4:
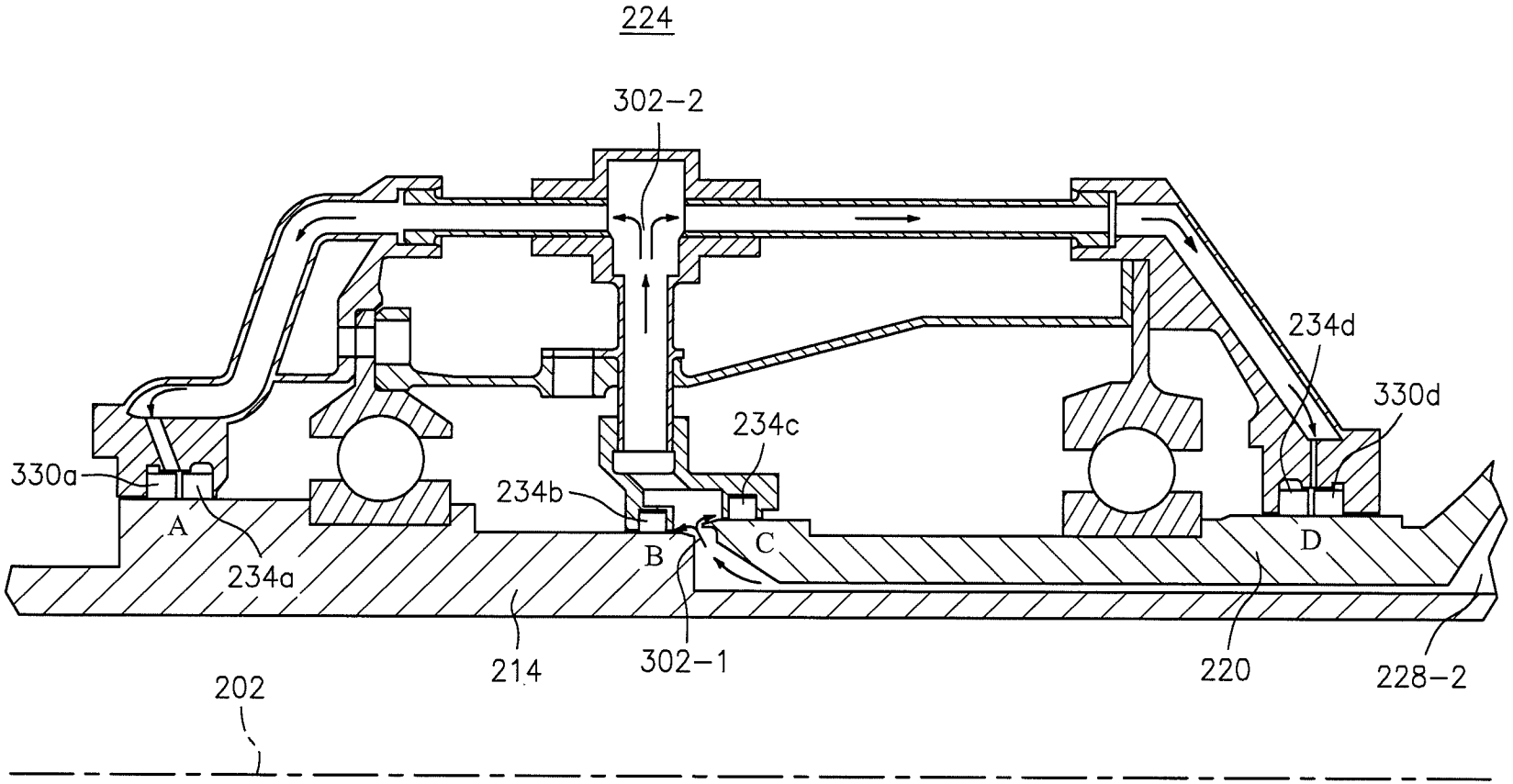
FIG. 4 is a cross sectional illustration of an intershaft compartment buffering arrangement.

FIG. 4 is a cross sectional illustration of an embodiment of the intershaft compartment buffering arrangement illustrated in FIG. 3, with the locations A, B, C and D identified therein.

Aspects of the disclosure have been described in terms of illustrative embodiments thereof. Numerous other embodiments, modifications, and variations within the scope and spirit of the appended claims will occur to persons of ordinary skill in the art from a review of this disclosure. For example, one of ordinary skill in the art will appreciate that the steps described in conjunction with the illustrative figures may be performed in other than the recited order, and that one or more steps illustrated may be optional in accordance with aspects of the disclosure. One or more features described in connection with a first embodiment may be combined with one or more features of one or more additional embodiments.

What is claimed is:

1. A system associated with an engine having a central longitudinal axis, comprising:

a first shaft axially extending along the central longitudinal axis;

a second shaft coaxial with the first shaft;

a first air seal that seals between the first shaft and the second shaft at a first axial location;

a second air seal that seals between the first shaft and the second shaft at a second axial location;

a first oil seal that provides intershaft sealing between the first shaft and the second shaft at a third axial location;

a second oil seal that provides intershaft sealing between the first shaft and the second shaft at a fourth axial location axially adjacent to the third axial location; and a high pressure compressor that provides pressurized air to a first radially exterior side of the first air seal and to a second radially exterior side of the second air seal.

2. The system of claim 1, wherein the first air seal and the second air seal consume a portion of the air.

3. The system of claim 1, further comprising:

a first oil seal that is substantially located at the first axial location; and a second oil seal that is substantially located at the second axial location.

4. A gas turbine engine comprising:

an inner shaft;

an outer shaft concentrically surrounding at least a portion of the inner shaft, wherein an interface between the outer shaft and the inner shaft is located within an annulus;

an oil seal positioned within the annulus and configured to prevent lubricating oil in the annulus from entering the interface;

a first air seal that seals between the inner shaft and the outer shaft at a first axial location;

a second air seal that seals between the inner shaft and the outer shaft at a second axial location; and a high pressure compressor that provides pressurized air to (i) a radially exterior side of the oil seal, (ii) a radially interior side of the oil seal, (iii) a first radially exterior side of the first air seal and (iv) a second radially exterior side of the second air seal.

5. The gas turbine engine of claim 4, where the outer shaft comprises a high pressure compressor shaft and the inner shaft comprises a low pressure turbine shaft.

6. A gas turbine engine, comprising:

an intershaft seal separating a bearing compartment from an annulus and configured to prevent a lubricating oil in the bearing compartment from entering the annulus;

an outer shaft concentrically surrounding at least a portion of an inner shaft, where an interface between the outer shaft and the inner shaft is located within the annulus;

an oil seal positioned within the annulus and configured to prevent lubricating oil in the annulus from entering the interface;

a first air seal that seals between the inner shaft and the outer shaft at a first axial location;

a second air seal that seals between the inner shaft and the outer shaft at a second axial location; and a high pressure compressor that provides pressurized air to (i) a radially exterior side of the oil seal, (ii) a radially interior side of the oil seal, (iii) a first radially exterior side of the first air seal and (iv) a second radially exterior side of the second air seal.

7. A system for a gas turbine engine, comprising:

a first shaft axially extending along an engine central longitudinal axis;

a second shaft coaxial with and radially exterior to the first shaft;

a first air seal and oil seal pair at an axial upstream position that seals a bearing compartment with respect to one of the first shaft and the second shaft and a second air seal and oil seal pair at an axial downstream position that seals the bearing compartment with respect to another of the first shaft and the second shaft;

a plurality of intershaft seals radially between the first shaft and the second shaft and axially between the first air seal and oil seal pair and the second first air seal and oil seal pair;

a first air seal that seals between the first shaft and the second shaft at a first axial location;

a second air seal that seals between the first shaft and the second shaft at a second axial location; and wherein each of the intershaft seals is an oil seal and wherein buffer air diverted from an engine high pressure compressor is delivered to (i) a first intershaft space axially between at least a first pair of adjacent intershaft seals from the plurality of intershaft seals, (ii) a first radially exterior side of the first air seal and (iii) a second radially exterior side of the second air seal.

* * * * *